US005927508A

United States Patent [19]

Plath

[11] Patent Number: 5,927,508

[45] Date of Patent: Jul. 27, 1999

[54] METHOD AND APPARATUS FOR RECOVERING FINE GOLD FROM LOW GRADE ORES

[76] Inventor: David C. Plath, 3443 NW. Port Ct., Lincoln City, Oreg. 97367-4740

[21] Appl. No.: 08/807,610

[22] Filed: Feb. 27, 1997

Related U.S. Application Data

[60] Provisional application No. 60/018,364, May 16, 1996.

[51] Int. Cl.[6] ..... B03C 1/30

[52] U.S. Cl. ..... 209/40; 209/223.1; 209/215

[58] Field of Search ..... 209/40, 636, 632, 209/215, 223.1, 225, 458, 500, 506, 39

[56] References Cited

U.S. PATENT DOCUMENTS

| | | | |
|---|---|---|---|
| 588,252 | 8/1897 | Waer | 209/40 |
| 823,301 | 6/1906 | Snyder | 209/223.1 |
| 979,934 | 12/1910 | Davies | 209/223.1 |
| 1,480,315 | 1/1924 | Thompson et al. | 209/223.1 |
| 2,149,764 | 3/1939 | Frei | 209/215 |
| 2,822,089 | 2/1958 | Woodruff | 209/223.1 |
| 2,926,786 | 3/1960 | Craft et al. | 209/506 |
| 3,575,293 | 4/1971 | Nelson | 209/215 |
| 4,375,491 | 3/1983 | Honig | 209/506 |
| 4,543,178 | 9/1985 | Goldstein | 209/215 |
| 4,592,833 | 6/1986 | Perdue | 209/500 |
| 4,642,180 | 2/1987 | Kaufman | 209/506 |
| 4,842,721 | 6/1989 | Schloemann | 209/223.1 |
| 4,975,182 | 12/1990 | Barefoot | 209/40 |
| 5,033,332 | 7/1991 | Riley | 266/249 |
| 5,191,981 | 3/1993 | Young | 209/223.1 |
| 5,205,414 | 4/1993 | Martinez | 209/8 |

FOREIGN PATENT DOCUMENTS

| | | | |
|---|---|---|---|
| 256237 | 9/1963 | Australia | 209/40 |
| 133522 | 11/1951 | Sweden | 209/215 |

*Primary Examiner*—Janice L. Krizek
*Assistant Examiner*—Thuy V. Tran

[57] ABSTRACT

Recovery of gold fines from gold-bearing ores is achieved by flowing an aqueous slurry of particulate gold-bearing ore over a sluice supporting a mat of magnetically susceptible particulate material, which preferably includes the magnetite content of the ore or a quantity of magnetite added to the ore, the mat being disposed over a sheet of magnetic material in which magnetic poles extending across the sluice and alternate in polarity at spaced intervals along the length of the sluice.

4 Claims, 1 Drawing Sheet

METHOD AND APPARATUS FOR RECOVERING FINE GOLD FROM LOW GRADE ORES

This application claims the benefit of Provisional application, No. 60/018,364, filed May 16,1996.

BACKGROUND OF THE INVENTION

This invention relates to gold mining, and more particularly to the recovery of gold fines from low grade ores.

It is recognized that conventional mechanical processing of gold ores results in the loss of 10% or more of the gold content of the ore, because it is of such fine size that it does not respond to recovery by the procedures used to recover the larger size particulate gold.

Various mechanical procedures have been used and proposed for the purpose of recovering fine gold. One is the use of a gold pan. This method uses gravity, agitation and flotation to cause the heavier gold particles to sink to the bottom of the pan while lighter materials are caused to flow out of the pan. The pan limits the amount of material that can be handled as the process of separating the tails by density using a pan is a tedious one. In addition, as the content of heavy materials, such as the black, magnetically susceptible mineral magnetite, increases, the loss of fine gold also increases due to inter-particular collisions between the gold fines and this heavy mineral which cause the gold to remain mixed with the black sand being washed from the pan.

Another method is the use of a sluice. Traditional sluices generally are wooden troughs constructed with cross bars or riffles which allow the gold to be trapped against the riffles. However, a decrease in water flow from optimum can slow the passage of ore or increases in water flow can cause turbulence which causes the gold previously trapped to be reentrained in the flow and lost. To minimize these effects, sluice boxes have been modified by placing a mat of carpet or synthetic fiber beneath the riffles to help hold the gold that has been trapped. However, this requires the disassembling of the sluice in order to remove and recover the trapped gold from the mat.

Still another method of separating fine gold from ore is the use of a cast iron spiral fitted with magnets, as described in U.S. Pat. No. 5,205,414. This method effects separation by adding a heavy magnetic material such as magnetite to the ore mixture which concentrates in the separator with the gold and is then removed from the ore mixture by the use of magnets. This method requires the use of large quantities of magnetite which requires recycling. In addition, complex mechanical systems are necessary to use this method, thus driving up operating costs.

Another method proposed for separating fine gold from ore is the use of a continuously moving endless belt fitted with special riffle pockets, as disclosed in U.S. Pat. No. 5,033,332. Such equipment requires continual maintenance and frequent repair. In addition, scaling up this method is problematical.

Chemical methods, such as cyanide extraction and mercury amalgamation also are employed for large scale recoveries. However, they are environmentally and physically hazardous procedures.

SUMMARY OF THE INVENTION

In its basic concept, this invention recovers gold fines from low grade ores by lining the bottom surface of a sluice with flexible magnetic sheeting in which the magnetic poles are aligned normal to the direction of flow, and flowing an aqueous slurry of gold-containing ore over the sheeting, whereupon any magnetic or magnetically susceptible material in the ore, or supplemented to the ore, is collected on the sheeting as a magnetic mat which functions as a porous surface into which fine particles of gold settle and become trapped and hence removed from the slurry flowing along the sluice. Periodic removal of the magnetic mat and trapped gold fines, by increasing the flow of water through the sluice, effects recovery of the enriched gold ore.

It is the principal objective of this invention to provide method and apparatus of the class described which overcomes the aforementioned limitations and disadvantages of prior mechanical procedures for recovering gold fines.

Another objective of this invention is to provide method and apparatus of the class described which functions with a minimum amount of magnetic particulate material, provided either by the ore or by a minimum additional of magnetite to the magnetic sheeting.

A further objective of this invention is the provision of method and apparatus of the class described which involves apparatus components of simplified construction for economical operation, maintenance and repair.

The foregoing and other objects and advantages of this invention will appear from the following detailed description, taken in connection with the accompanying drawings of a preferred embodiment.

DESCRIPTION OF THE PREFERRED EMBODIMENT

Figure 1:
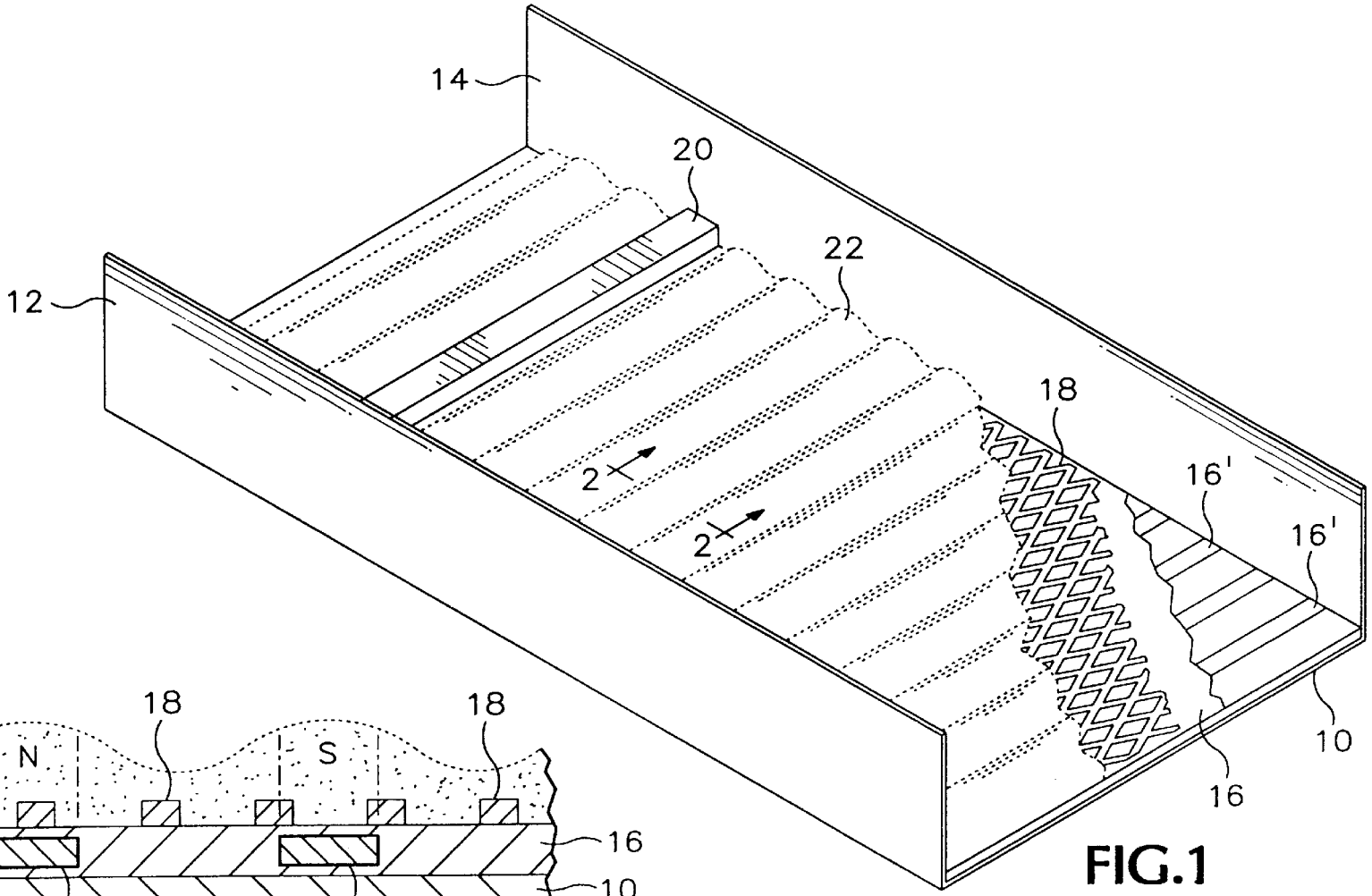
FIG. 1 is a perspective view of a schematic illustration of apparatus embodying the features of this invention portions being broken away to disclose the layer assembly.
Figure 2:
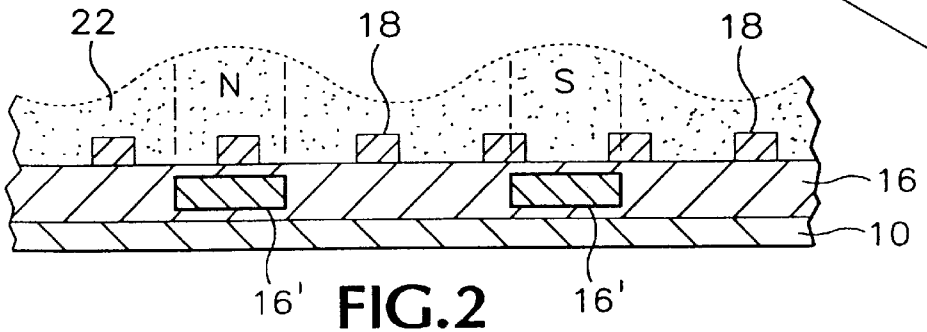
FIG. 2 is a fragmentary longitudinal section taken on the line 2—2 in FIG. 1.

Referring to the drawings, there is illustrated schematically apparatus by which the method of this invention may be practiced. The apparatus includes a sluice frame formed of a bottom 10 and opposite side walls 12 and 14. The frame preferably is made of non-corrosive, lightweight material, such as aluminum or synthetic resin. Secured over the sluice frame bottom is a sheet 16 of flexible magnetic material, such as a polymeric sheet in which a magnetizable substance is incorporated. The sheet then is magnetized to produce a multiplicity of magnetic poles 16' of alternating polarity extending transversely across the sheet relative to the longitudinal direction of the sluice frame, as illustrated in FIG. 2. These poles generally are spaced apart about 4 to 8 poles per inch.

In the embodiment illustrated, traditional riffles are utilized to accommodate recovery of gold in a wide variety of sizes, in addition to fines. One form of riffle is a sheet of expanded metal or other material 18 overlying the magnetic sheet, to provide pockets into which particulate gold is captured. The expanded material also serves to protect the underlying magnetic sheet from abrasion by particulate ore flowing over the sluice.

A second form of riffle is shown in the form of transversely extending bar 20 which serves to trap larger gold flakes and nuggets. A plurality of such bars may be spaced apart in the longitudinal direction of the sluice, as desired.

Overlying the magnetic sheet 16 is a mat 22 of magnetic or magnetically susceptible material, supplied either from the ore being processed through the sluice, or by the addition of magnetite or other magnetically susceptible particulate material. In either case, the mat of magnetically susceptible material forms a porous layer into which gold fines can settle out of the slurry and become trapped.

When fully charged with magnetite, or other magnetically susceptible material, the mat 22 has the appearance of black corduroy, the wales of which are created by the magnetite adhering to the spaced magnetic poles 16 of the flexible magnetic sheeting 16.

In operation, an aqueous slurry of particulate gold-bearing ore is flowed by gravity over the assembly of layers on the sluice frame. Larger particles of gold are trapped by the riffles 18 and/or 20 and gold fines are trapped in the porous mat 22 of magnetically susceptible material overlying the magnetic sheet 16. Periodically increasing the flow of water through the sluice effects removal of the mat and entrapped gold fines for separation and recovery of the gold content.

Experiments confirming the effectiveness of the method and apparatus described hereinbefore have been conducted on beaches where, by the nature of seasonal changes in wave action, black sand banks of dense minerals are noted during the winter months. These sand banks were found to have a higher concentration of gold than those beaches where the sand is predominantly white, and therefore has not been pre-concentrated by wave action. Where these banks are found in conjunction with a small beach stream, it is possible to place the sluice, regulate of the flow of water, and then process a ton of sand in a few hours. These experiments determined that the sluice of this invention recovered gold more efficiently than panning in the conventional manner. A pan full of black sand can weigh as much as 20 pounds and is therefore difficult to operate without losing a significant portion of the gold content. In panning the mat 22 collected from the sluice following an experiment, it is observed that the material could be serially panned several times without recovering the entire gold content originally trapped by the sluice of this invention.

It will be apparent to those skilled in the art that various changes and modifications may be made in the size, shape, type, number and arrangement of parts described hereinbefore, as well as variations in the recovery process, without departing from the spirit of this invention and the scope of the appended claims.

I claim:

1. The method of recovering fine gold from gold-bearing ore, comprising flowing a liquid slurry of particulate gold-bearing ore over a porous mat of magnetically susceptible particulate material overlying a flexible sheet of magnetic material arranged in rows of alternating polarity spaced apart in the direction of slurry flow, each row extending perpendicular to the direction of slurry flow.

2. The method of claim 1 wherein the layer of magnetically susceptible particulate material includes magnetite.

3. Apparatus for recovering fine gold from gold-bearing ore, comprising:

a) a sluice having a bottom and lateral side walls and defining longitudinal ends of the sluice, b) a flexible sheet of magnetic material supported on the sluice bottom and arranged in rows of alternating polarity extending across the sluice bottom and spaced apart in the direction of the flow through the sluice, and c) a porous mat of magnetically susceptible particulate material overlying the magnetic material and for trapping fine particles of gold.

4. The apparatus of claim 3 wherein the layer of magnetically susceptible particulate material includes magnetite.

* * * * *